US005226016A

United States Patent [19]

Christman

[11] Patent Number: 5,226,016

[45] Date of Patent: Jul. 6, 1993

[54] ADAPTIVELY FORMED SIGNAL-FREE REFERENCE SYSTEM

[75] Inventor: Russel A. Christman, Old Lyme, Conn.

[73] Assignee: The United States of America as represented by the Secretary of the Navy, Washington, D.C.

[21] Appl. No.: 872,263

[22] Filed: Apr. 16, 1992

[51] Int. Cl.[5] ..... H04R 27/00

[52] U.S. Cl. ..... 367/135; 367/901; 381/94; 381/71

[58] Field of Search ..... 367/901, 124, 136, 135; 381/94, 71; 364/574

[56] References Cited

U.S. PATENT DOCUMENTS

| | | | |
|---|---|---|---|
| 4,489,441 | 12/1984 | Chaplin | 381/71 |
| 4,589,137 | 5/1986 | Miller | 381/94 |
| 4,649,505 | 3/1987 | Zinser, Jr. et al. | 381/71 |
| 4,723,294 | 2/1988 | Taguchi | 381/71 |
| 4,965,834 | 10/1990 | Miller | 381/94 |
| 5,068,834 | 11/1991 | Fromont | 367/135 |

OTHER PUBLICATIONS

Widrow et al., "Adaptive noise Canceling: Principles and Applications," *Proceedings IEEE*, vol. 63, No. 12, pp. 1692–1716, Dec. 1975.

*Primary Examiner*—Daniel T. Pihulic
*Attorney, Agent, or Firm*—Michael J. McGowan; Prithvi C. Lall; Michael F. Oglo

[57] ABSTRACT

A method and apparatus are provided to adaptively form an optimum signal-free reference used to cancel near-field noise in an adaptive plate-noise cancellation system. First, second and third pressure sensors are positioned to detect any near-field plate-radiated noise. The first sensor is positioned closest to the plate, the third sensor is positioned furthest from the plate, and the second sensor is positioned between the first and third sensors. An acoustic far-field projector generates a plurality of broadband signals from a plurality of incidence angles. Each broadband signal is projected at an amplitude indicative of a noise-off condition. Outputs from the first and third sensors are combined to form a dipole responsive to each broadband signal). A feedback system is operatively associated with the dipole and the second sensor. The feedback system includes an adaptive filter that converges to generate an optimum signal-free reference for each of the plurality of the broadband signals and stores filter coefficients indicative of the optimum signal-free reference for each of the broadband signals. Switching means are provided to selectively switch the adaptive filter out of the feedback system such that the stored filter coefficients may be used.

6 Claims, 2 Drawing Sheets

ADAPTIVELY FORMED SIGNAL-FREE REFERENCE SYSTEM

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The present invention relates generally to adaptive signal processing, and more particularly to an adaptive signal processing system for forming an optimum signal-free reference for ultimate use in an adaptive hull-radiated noise cancellation system.

(2) Description of the Prior Art

Adaptive signal processing methods have been developed for the cancellation of submarine sonar hull-radiated noise in the near-field region of the submarine hull. The procedure typically utilizes three hydrophone pressure sensors aligned normal to the hull. The hydrophones are positioned within the near-field of any hull noise that may be generated. This is a region where the noise decays exponentially with respect to distance from the hull. It is well defined by the material properties of the hull structure and frequency range of interest as is well known in the art.

The pressure measured by the hydrophones contains both target signals and unwanted hull-radiated noise components. The adaptive signal processing procedure is based on the circuitry developed by Widrow for noise cancellation. See "Adaptive Noise Canceling: Principles and Applications," by Widrow et al., Proceedings IEEE, Volume 63, No. 12, pp. 1692–1716, December 1975. Such circuitry requires a sensor which measures both signal and noise and is referred to as the primary sensor. More importantly, a secondary input, referred to as the reference, requires a sensor that measures noise only and must therefore be "signal-free". This reference input is filtered adaptively by using the Least Mean Square (LMS) algorithm which attempts to produce an output that is a replica of the noise on the primary input. The subtraction of the filtered reference replica from the primary input then provides the cancellation of noise. A "signal-free" reference is thus an essential requirement for an effective adaptive noise cancellation system. If any portion of the signal is present on the reference channel, the signal as well as noise may be canceled adaptively. This would reduce the effectiveness of the adaptive noise cancellation system as well as any other systems that are required for post-processing of signals.

One method of generating the "signal-free" reference is disclosed by Miller in U.S. Pat. No. 4,589,137, issued May 13, 1986. Miller teaches the use of a three element line of hydrophones, or tripole, as the reference channel input source. The signal-free reference is arrived at by trial-and-error adjustment of a plurality of preamplifiers and phase shifters. Adjustment is required for each of twenty or more narrow frequency bins in order to achieve a wide band signal-free reference. This process is time consuming, is prone to operator error and typically lacks sufficient frequency resolution since the time required to generate each (frequency dependent) signal-free reference limits the number of frequencies processed.

SUMMARY OF THE INVENTION

Accordingly, it is an object of the present invention to provide a method and apparatus that generates a signal-free reference for ultimate use in an adaptive noise cancellation system.

Another object of the present invention is to provide method and apparatus that generates optimum signal-free references over a wide frequency band of interest.

Still another object of the present invention is to provide a method and apparatus that generates optimum signal-free references over a wide frequency band of interest quickly and with minimal operator involvement.

Yet another object of the present invention is to provide a method and apparatus that generates an optimum signal-free reference used to cancel near-field, plate-radiated noise in an adaptive noise cancellation system.

Other objects and advantages of the present invention will become more obvious hereinafter in the specification and drawings.

In accordance with the present invention, a method and apparatus are provided for adaptively forming an optimum signal-free reference used to cancel near-field noise in an adaptive plate-noise cancellation system. First, second and third pressure sensors are aligned in a straight line normal to a plate and are in the near-field of any generated plate-noise. The first sensor is positioned closest to the plate, the third sensor is positioned furthest from the plate, and the second sensor is positioned between the first and third sensors. An acoustic farfield projector generates a plurality of broadband signals from a plurality of incidence angles. Each broadband signal is projected at an amplitude indicative of a noise-off condition. Outputs from the first and third sensors are combined to form a dipole responsive to each broadband signal. The second sensor is adaptively filtered then subtracted from the dipole to form the reference output. A feedback system is connected between this output and the adaptive filter. Using outputs from both second sensor and feedback system, the adaptive filter converges to generate an optimum signal-free reference for each of the plurality of the broadband signals and stores filter coefficients indicative of the optimum signal-free reference for each of the broadband signals. Switching means are provided to selectively switch the adaptive filter out of the feedback system such that the stored filter coefficients may be recalled as needed.

BRIEF DESCRIPTION OF THE DRAWING(S)

FIG. 1 is a block diagram of the apparatus used to form the signal-free reference according to the present invention; and FIG. 2 is a block diagram of an adaptive hull-noise cancellation system using the signal-free reference apparatus of FIG. 1.

DESCRIPTION OF THE PREFERRED EMBODIMENT(s)

Figure 1:
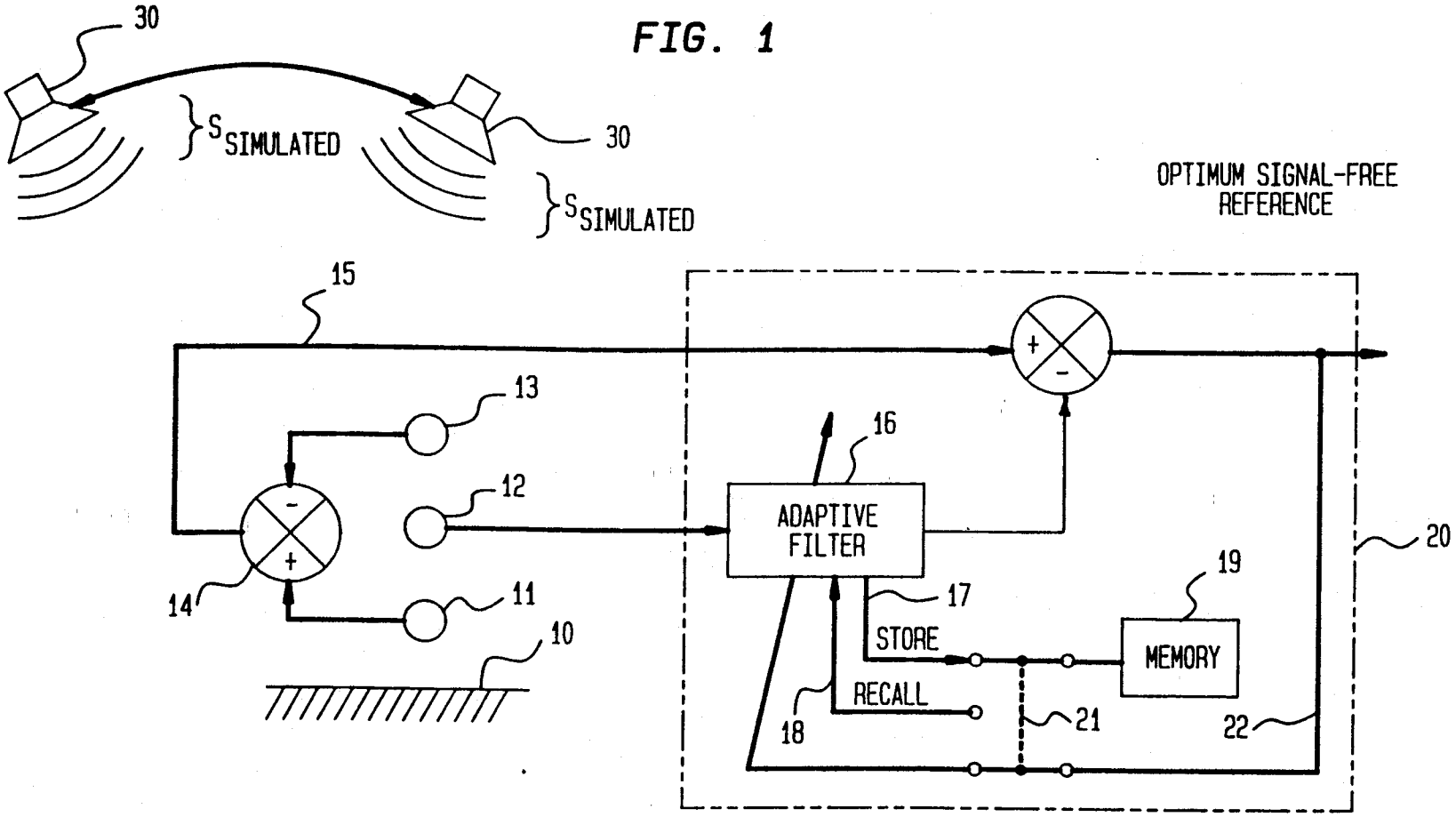

Referring now to the drawings, and more particularly to FIG. 1, a block diagram is shown of the apparatus used to form a signal-free reference according to the present invention. The method and apparatus of the present invention will be described simultaneously as they pertain to a hull-radiated noise cancellation system for a ship or submarine. However, as will be readily apparent to one skilled in the art, the method and apparatus of the present invention are adaptable to any noise cancellation system in which wall or plate-radiated noise is a concern.

In FIG. 1, three hydrophones 11, 12 and 13 are mounted above a section of the ship's hull plating 10. Hydrophones 11, 12 and 13 are aligned with one another and are normal to hull plating 10. Since it is near-field hull-radiated noise that is of concern, all these hydrophones must lie within the near-field noise region of hull plating 10. (While hull-radiated noise is comprised of near-field and far-field components, they are uniquely different and as a result are not correlated.) The near-field positioning and normal alignment of the three hydrophones provide a high degree of noise correlation among the hydrophones. This is an essential requirement for effective adaptive noise cancellation. The distance from hull plating 10 at which the near-field dominates can be determined based on hull plating material properties and size as is well known in the art.

The spacing between each hydrophone is not rigidly constrained. Theoretically, any spacing greater than zero will work as long as the hydrophones remain within the near-field. However, practically speaking, very small spacing may result in low level uncorrelated hydrophone-to-hydrophone electronic noise which can dominate and degrade performance of the system. Accordingly, typical spacing ranges from 2.5 to 7.5 centimeters. Further, it is not a requirement of the present invention that hydrophones 11, 12 and 13 be evenly spaced as is necessary in prior art methods.

An acoustic far-field projector 30 is movably positioned as shown to project broadband target-like signals through the water towards hull plating 10 from a variety of incidence angles. The acoustic waves that arrive at hydrophones 11, 12 and 13 look exactly like that of a target, but are controlled in amplitude. Specifically, the amplitude is adjusted to be well above expected near-field, hull-noise levels resulting in an effective "noise off" condition. Amplitude adjustment of projector 30 is thus a factor of the amplitude of hull-noise during calibration. As a minimum, the calibration signal amplitude should be 10 times greater than the hull-noise amplitude.

In response to the signals from projector 30, outputs from hydrophones 11 and 13 are combined at a summer 14 thereby forming a dipole output 15. In response to the same signals, output from hydrophone 12 is provided as a reference input to a filter 16. Filter 16 is further part of an adaptive feedback system indicated by that portion of the block diagram within dotted line box 20.

Adaptive feedback system 20 is a conventional noise canceling circuit known in the art. When a double pole, double throw switch 21 is closed as shown, filter 16 acts as an adaptive filter that is responsive to an error signal on feedback line 22. Thus, when switch 21 is closed and hydrophones 11, 12 and 13 are subjected to the target-like signals $S_{simulated}$ from projector 30, filter 16 converges to a value that results in a minimum error voltage on line 22. This minimized error voltage is characteristic of any such cancellation circuit employing the Least Mean Square algorithm taught by Widrow. The minimized error voltage serves as the optimum signal-free reference since the signals from projector 30 simulate a "noise off" condition. This procedure is repeated for a variety of positions (i.e. incidence angles) of projector 30 until a desired granularity is achieved. The coefficients used by filter 16 are stored in a memory 19 via path 17 (switch 21 closed) for the optimum signal-free references at all incidence angles. In other words, filter 16 has been trained to effectively cancel any incoming signal from projector 30.

Figure 2:
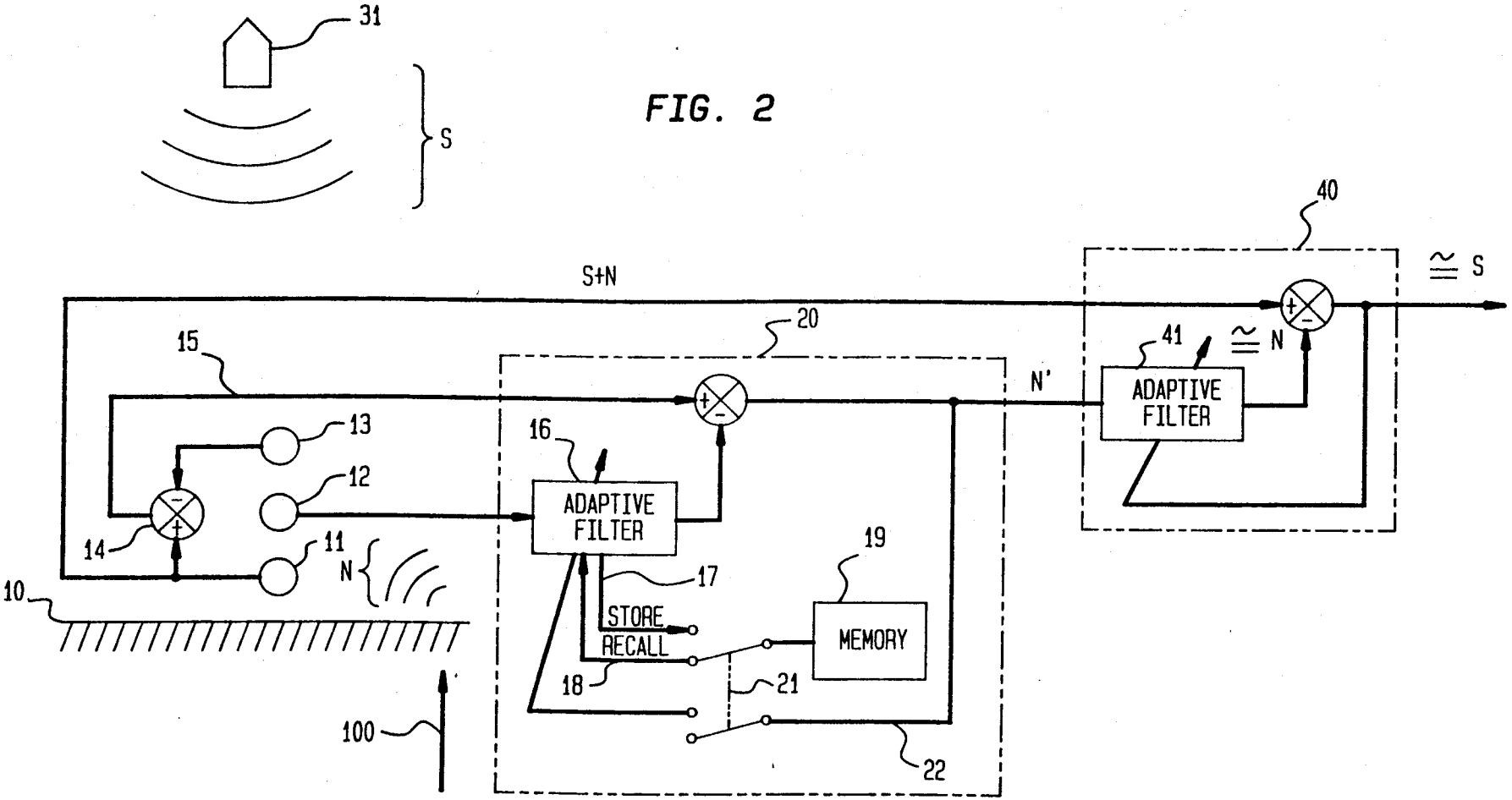

Typically, the apparatus of the present invention used to adaptively form a signal-free reference is part of an adaptive hull-noise cancellation system shown in FIG. 2. Common elements share common reference numerals where appropriate. Once the desired granularity is achieved, switch 21 may be opened to essentially eliminate feedback line 22 from the adaptive feedback system 20. In operation, a far-field target 31 radiates acoustic waves S towards hydrophones 11, 12 and 13. Stored filter coefficients are recalled from memory 19 via path 18 (switch 21 opened) for optimum signal cancellation. At the same time, hull plating 10 is typically subjected to an excitation force, shown by arrow 100, due primarily to ship movement and/or engine noise. Excitation force 100 thus generates hull-radiated noise N in the near-field of hull plating 10. Hydrophone 11 nearest to hull plating 10 is the primary hydrophone for sensing both signal S and noise N and producing an output (S+N) indicative thereof as shown.

The weighted sum of hydrophones 11, 12 and 13, or optimum signal-free reference N', is somewhat modified with respect to the noise N. This is due to the amplitude and phase differences between hydrophone 11 and the weighted sum of all three hydrophones. Thus, the signal-free reference N' must be applied to an adaptive filter 41 which is part of another adaptive feedback loop 40. As is known in the art, adaptive filter 41 and feedback loop 40 work to minimize the error/adaptive output. Since the optimum signal-free reference N' is an approximation of the noise N, adaptive filter 41 converges to a multiplying factor of approximately N/N' to yield a filter output that is approximately equal to N. This approximation of N is then subtracted from the (S+N) output of hydrophone 11 to yield an output that is approximately equal to S.

The advantages of the present invention are numerous. By training a filter to output an optimum signal-free reference, an adaptive noise canceling system is able to extract the signal from a noisy environment. This extraction occurs without the loss of any signal since there is no excess signal on the signal-free reference. This allows a follow-on adaptive noise cancellation process to maintain the signal structure.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A method of adaptively forming an optimum signal-free reference used to cancel near-field noise in an adaptive platenoise cancellation system, comprising the steps of:

aligning, in the near-field of any generated platenoise, first, second and third pressure sensors in a straight line normal to a plate, wherein the first sensor is positioned closest to the plate, the third sensor is positioned furthest from the plate, and the second sensor is positioned between the first and third sensors;

subjecting the three sensors to a broadband signal from an acoustic far-field projector, the broadband signal having an amplitude effective to provide a noise-off condition;

combining outputs from the first and third sensors to form a dipole responsive to the broadband signal;

weighting, at an adaptive filter, an output from the second sensor responsive to the broadband signal;

generating an error signal as the difference between the output from the dipole and the weighted output from the second sensor; and applying the error signal to the adaptive filter, wherein convergence of the adaptive filter is indicative of an optimum signal-free reference.

2. A method according to claim 1 further comprising the step of storing coefficients of the adaptive filter indicative of the optimum signal-free reference.

3. A method according to claim 1 wherein the broadband signal is successively propagated towards the three sensors from a plurality of incidence angles.

4. In an adaptive plate-noise cancellation system having first, second and third hydrophone pressure sensors aligned in a straight line normal to a plate, the first sensor being positioned closest to the plate, the third sensor being positioned furthest from the plate, and the second sensor being positioned between the first and third sensors, wherein all three sensors lie in the near-field of any generated plate- noise, a method of adaptively forming an optimum signal-free reference used to cancel near-field noise in the cancellation system comprising the steps of:

successively subjecting the three sensors to a plurality of broadband signals projected from a plurality of incidence angles, each broadband signal having an amplitude indicative of a noise-off condition;

combining outputs from the first and third sensors to form a dipole responsive to each of the broadband signals;

providing, in operative association with the dipole and the second sensor, a feedback system having an adaptive filter that converges to generate an optimum signal-free reference for each of the broadband signals; and storing, for each of the broadband signals, filter coefficients of the adaptive filter indicative of the optimum signal-free reference.

5. An apparatus for adaptively forming an optimum signal-free reference used to cancel near-field noise in an adaptive platenoise cancellation system comprising:

first, second and third pressure sensors aligned in a straight line normal to a plate and in the near-field of any generated plate-noise, wherein the first sensor is positioned closest to the plate, the third sensor is positioned furthest from the plate, and the second sensor is positioned between the first and third sensors;

an acoustic far-field projector for generating a plurality of broadband signals projected from a plurality of incidence angles, each broadband signal being successively projected at an amplitude indicative of a noise-off condition;

means for combining outputs from the first and third sensors to form a dipole responsive to each broadband signal;

a feedback system, operationally associated with dipole and the second sensor, having an adaptive filter that converges to generate an optimum signal-free reference for each of the plurality of the broadband signals and stores filter coefficients indicative of the optimum signal-free reference for each of the broadband signals; and means for selectively switching said filter out of said feedback system, wherein said adaptive filter uses the stored filter coefficients.

6. An apparatus as in claim 5 wherein the plate is a submarine hull and said first, second and third sensors are hydrophones.

* * * * *